US006223781B1

(12) United States Patent
Yamada et al.

(10) Patent No.: US 6,223,781 B1
(45) Date of Patent: May 1, 2001

(54) JOINING LOOP FOR JOINING INDUSTRIAL BELT AND JOINING PART OF INDUSTRIAL BELT USING THE LOOP

(75) Inventors: Jinzo Yamada; Senri Itoh, both of Tokyo (JP)

(73) Assignee: Nippon Filcon Co. Ltd. (JP)

( * ) Notice: Subject to any disclaimer, the term of this patent is extended or adjusted under 35 U.S.C. 154(b) by 0 days.

(21) Appl. No.: 09/502,589

(22) Filed: Feb. 11, 2000

(30) Foreign Application Priority Data

Feb. 16, 1999 (JP) ..... 11-076263

(51) Int. Cl.[7] ..... D03D 13/00
(52) U.S. Cl. ..... 139/383 AA
(58) Field of Search ..... 139/383 AA

(56) References Cited

U.S. PATENT DOCUMENTS 5,092,373 * 3/1992 Lee ..... 139/383 AA
5,377,722 * 1/1995 Jaala ..... 139/383 AA
5,531,251 * 7/1996 Rydin ..... 139/383 AA
5,601,691 * 2/1997 Kufferath ..... 139/383 AA
5,913,339 * 6/1999 Lee ..... 139/383 AA
6,000,441 * 12/1999 Lee et al. ..... 139/383 AA

* cited by examiner

*Primary Examiner*—Andy Falik
(74) *Attorney, Agent, or Firm*—Rader, Fishman & Grauer

(57) ABSTRACT

A joining loop in combination with an industrial fabric, each end of the fabric including an arrangement of wefts in multiple layers, where the first end has a remaining weft in at least an upper layer, and a loop forming part below the remaining weft where a removed weft would normally be disposed, the joining loop having first and second warps folded back respectively into the first and second ends to form first and second end-joining loops. A core line is inserted in a common hole of the joining loop, the common hole being formed by engaging both end-joining loops with each other. The first warp of the joining loop is folded back in the loop forming part, woven with the remaining weft, and woven at a tip end of the first warp into an ordinary part to form the first end-joining loop. The second warp of the joining loop is folded back, and woven into the ordinary part without weaving the second warp with the remaining weft, to form the second end-joining loop.

16 Claims, 10 Drawing Sheets

JOINING LOOP FOR JOINING INDUSTRIAL BELT AND JOINING PART OF INDUSTRIAL BELT USING THE LOOP

FIELD OF TECHNOLOGY

The present invention relates to joining loops of joined parts of endless industrial fabrics such as a papermaker's fabric, a fabric for manufacturing a nonwoven material, a fabric for use in dewatering or squeezing sludge, a belt for manufacturing a building material, and a conveyor belt and to the joined parts

BACKGROUND OF THE INVENTION

Examples of the industrial fabrics heretofore used include papermaking fabrics such as a papermaker's forming fabric and a papermaker's forming canvas, nonwoven material manufacturing fabrics, sludge dewatering fabrics, building material manufacturing belts, and conveyor belts.

These industrial fabrics are processed in an endless manner, and attached to machines such as a papermaker and a dehydrator for use.

As a method of processing the endless shape, there are a large number of known methods such as a method of joining both ends of an industrial fabric by seams, a method of engaging loops formed on both ends using the warp of the industrial fabric itself with each other and passing a pin therethrough, a method of engaging spiral loops formed on both ends of an industrial fabric with each other and passing a pin therethrough, and a method of engaging metal hooks called clipper lacing attached to both ends of an industrial fabric with each other and passing a pin therethrough. These methods are employed in accordance with purposes.

However, each of the conventional processing methods had some problems.

When various performances such as the same smoothness as that of an ordinary part are required for a joined part of an industrial fabric, the method of joining by seams is the most suitable way in which the joined part is woven with the ordinary part and equally formed in substantially the same texture.

However, the method of joining by seams has a large problem that much labor is required, and has a critically large defect depending on devices to use.

Specifically, in the method of engaging the loops with each other in the endless manner, the endless or ended shape can freely be formed by extracting or inserting the joining pin. In the method of joining by seams, however, once the endless shape is formed, the shape cannot be returned to the ended shape until it is cut. If the endless or ended shape can freely be formed, the fabric having the ended state is extended between rollers of the device, and the endless shape can be formed on the spot during attachment to the device to use, so that the attachment to the device is very easy. For example, the attachment comprises setting the old used industrial fabric attached to the device to be in the ended state, connecting one end of a new industrial fabric to be attached to one end of the old fabric, operating the device to move and extend the industrial fabric between the rollers of the device, removing the old industrial fabric when the fabric is once moved around and entirely extended, and attaching the new industrial fabric in the endless shape.

On the other hand, in the method of joining by seams in which the endless or ended shape cannot freely be formed, a so-called cantilever system has to be performed. The system comprises supporting the rollers of the device on one side, removing supports, and other obstacles from the other side and inserting and extending the industrial fabric in a width direction from one side of the device.

However, the cantilever system has disadvantages that the manufacture cost of the machine itself increases, the device is enlarged in size, and that a large installation space is necessary.

Moreover, for the use of a very heavy or long industrial fabric, since it is difficult to insert the fabric, the system is unsuitable. Therefore, in the actual circumstances, the above-described cantilever system is unemployed in most cases excluding the papermaker's forming fabric used in the forming section of the paper making machine in which surface smoothness is regarded as very significant.

Therefore, in most cases the method of forming the loop or the method by the metal hook is employed as the method of forming the endless shape, because the ended shape can be formed again.

SUMMARY OF THE INVENTION

In the method, however, it is necessary to separately attach the spiral line or the metal hook which is a structure completely different from that of the industrial fabric. Even in the formation of the loop, since the texture of the loop forming part is different from the woven texture of the ordinary part, the loop is protruded from the end.

Therefore, since the structure of the joined part is completely different from that of the ordinary part, and a difference is produced in smoothness and air permeability, the loop, spiral line or metal hook directly contacts and puts a mark on a conveyed material, dewatering or drying non-uniformity is generated in the dewatering or drying industrial fabric, and other problems are caused.

Moreover, a large gap is frequently generated usually in the joined part as compared with the ordinary part, and the conveyed material disadvantageously leaks in this case.

To solve these problems, there are proposed a method of weaving a yarn provided with flexibility and elasticity into the loop part, a method of weaving in a tufted yarn and combing a yarn end to cover the top surface of the joined part, and other methods. In any case, however, since the structure of joining part is still different from that of the ordinary part of an industrial fabric, any of the methods could not provide a fundamental solution.

According to the present invention, in consideration of the above-described problems of the conventional joining methods, there are provided a joining loop of a joined part and the joined part formed in a joining method in which the loop is formed so that an endless or ended shape can freely be formed but the structure of a conveying surface of the joined part is formed in a structure substantially equal to that of an ordinary part.

The prevent invention relates to a joining loop of an industrial fabric joined by folding back a warp to both ends of the ended industrial multilayered fabric in which a weft is arranged in multiple layers to form the joining loop, and inserting a core line in a common hole of the joining loop formed by engaging both end joining loops with each other, the joining loop comprising: leaving at least one thread of weft of at least an upper layer part of the end;

removing the weft below the remaining weft of the upper layer part to form a loop forming part; folding back the warp of one end in the loop forming part; weaving the folded warp with the remaining weft of the upper layer part and weaving a tip end of the warp into an ordinary part to form the joining loop; folding back the warp of the other end; weaving the folded warp into the ordinary part without weaving the warp with the remaining weft of the upper layer part to form the joining loop; and forming the common hole below the upper layer weft. The warp of one end may be folded back in the loop forming part of the joining loop of the industrial fabric. Then the folded warp may be woven with the remaining weft of the upper layer part in the same woven texture as an upper layer woven texture of the ordinary part. The tip end of the warp can be woven into the ordinary part to form the joining loop. Further, at least one thread of weft of at least the upper layer part of the end can be left. Then the wefts below the remaining wefts of the upper layer part can be removed to form the loop forming part. The warp of one end weaving in the remaining weft of the upper layer part is folded back in the loop forming part, and the remaining part of the warp can be woven into the ordinary part to form the joining loop.

In addition, with regard to the loop forming part of the joining loop of the industrial fabric above, the warp of the other end may be also folded back. The folded warp can be woven with the remaining weft of the upper layer part and the tip end of the warp can be woven into the ordinary part to form the joining loop. In this case, the warp of the other end may also be folded back in the loop forming part of the joining loop. Then the folded warp can be woven with the remaining weft of the upper layer part in the same woven texture as an upper layer woven texture of the ordinary part and the tip end of the warp can be woven into the ordinary part to form the joining loop.

In the loop forming part of the joining loop of the industrial fabric above, the warp of the other end weaving in the remaining weft of the upper layer part may be folded back, and the remaining part of the warp may be woven into the ordinary part to form the joining loop. Further, the warp folded back and woven into the ordinary part can be butt-joined with the warp cut to an adjusted length to form one thread of warp. In other case, the warp can be folded back, and woven into the ordinary part between adjacent warps. Additionally, the joined part of an industrial fabric joined by inserting a core line into a joining loop common hole formed by engaging both end joining loops with each other. In this case, an upper layer texture of the joined part of the industrial multilayered fabric formed in an endless shape using the joining loop can be the same as the upper layer texture of the ordinary part of the multilayered fabric. Alternatively, the upper layer texture of the joined part of the industrial multilayered fabric formed in an endless shape using the joining loop can be different from the upper layer texture of the ordinary part of the multilayered fabric.

At the joined part of the industrial fabric above, the warps of both end textures of the fabric joined in an endless manner using the joining loop deviate by one thread to a plurality of threads and the loops may be engaged. Alternatively, at the joined part of the industrial fabric, in which both end warps of the fabric joined in the endless manner using the joining loop are engaged with the loop of the same warp.

PREFERRED EMBODIMENTS OF THE INVENTION

Figure 1:
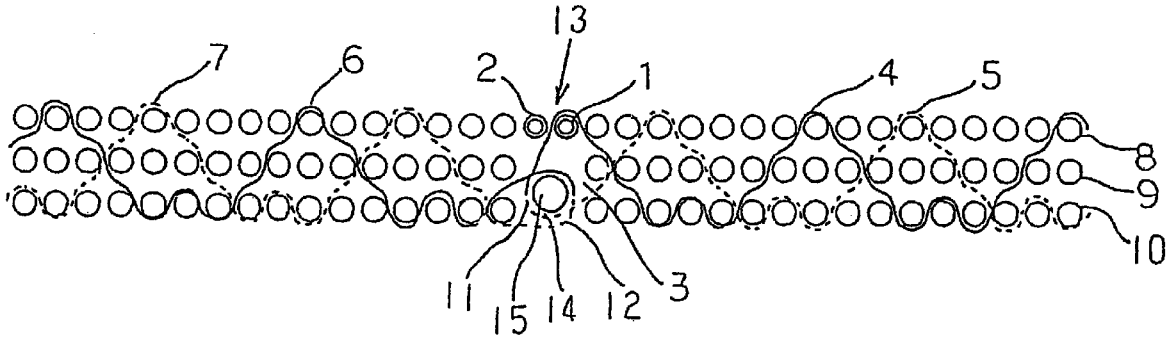
FIG. 1 is a sectional view showing a joining loop according to an embodiment of the present invention.

In the present invention, a joining loop is formed by leaving at least one weft of at least an upper layer part of an end or ends, removing a weft or wefts below the remaining weft of the upper layer part to form a loop forming part, and folding back the warp or warps of one end and weaving the warp or warps with the remaining weft of the upper layer part in the loop forming part, and a common hole of both end loops is formed below the upper layer weft by engaging the loops with each other.

According to the above-described constitution, the upper layer weft exists above the common hole formed by engaging the joining loops with each other, that is, on the upper layer surface of the joined part in a similar manner as in the ordinary part, and no joining loop appears or no gap is produced in the upper layer surface.

In the present invention, the joining loop means the loop for forming the common hole, and does not mean the warp which is simply folded back to press the weft of the end.

Moreover, the warp forming the loop and folded back is woven into the ordinary part where the adjacent warp is to exist, and butt-joined with the adjacent warp cut in the appropriate portion of the ordinary part. Specifically, the loop is formed by one set of two threads of warps, but the present invention is not limited to this, and the warp forming the loop and folded back may be woven into a warp part which is not adjacent but is far, or may be woven between two adjacent threads of warps. Of course this also applies to the warp forming no loop. Furthermore, the warp forming no loop may simply be cut in the middle or end of the ordinary part without being folded back.

For the joining loop of the present invention, when one loop is formed in a repeating unit in a width direction, the remaining upper layer weft fails to drop without any problem, and other warps may form the joining loop, or may simply be folded back.

The joining loop can be formed on all warps or on every other thread and/or every plurality of threads of warps.

When all the warps and the remaining upper layer weft are woven in a similar manner as the upper layer woven texture of the ordinary part, the upper layer weft exists on the conveying surface of the joined part, and additionally the same texture as that of the ordinary part is preferably obtained.

Here, all the warps mean that both a folded-back warp and a warp butt-joined with the folded warp in the ordinary part to form one thread of warp are regarded as the same warp, and in this case both the warps are not regarded as separate warps. In other words, when a warp is folded back and woven into the part of the other warp texture, the warp forms a warp of the woven part in terms of texture.

Furthermore, by setting the relation in woven texture of the warps and the upper layer weft between both ends to be the same as in the ordinary part, most preferably the joined part can be formed in the same manner as the ordinary part.

[0007]

Moreover, in the present invention the remaining upper layer weft is not limited to the uppermost layer weft, and the weft of a middle layer may be allowed to remain. In this case there are disadvantages that the loop forming part is reduced in size and the loop therefore becomes difficult to be formed and that the loop diameter is also reduced in size and the joining pin therefore becomes difficult to pass. However, there are advantages that, since the structure of the joined part becomes more similar to that of the ordinary part, differences in various performances such as air permeability can be minimized.

Moreover, the part obtained by allowing not only the upper layer weft but also a lower layer weft to remain and removing the middle layer weft may be used as the loop forming part. In this case, there is a disadvantage that it is difficult to pass the joining pin because the loop common hole is invisible. On the other hand, there is an advantage that the structure of a lower layer surface can be formed equally to the ordinary part.

In the present specification, the upper layer part generally means an upper layer part of an industrial fabric when used, and is a side where a material to convey, a wet building material, or a material to dewater contacts. The lower layer surface means a side of an industrial fabric where a conveying roller or the like contacts. Of course depending on the device to use, the upper layer surface is positioned downward and contacts the material to convey, and the like in some cases, and the upper layer surface forms a running surface side in other cases.

Additionally, the woven texture of the industrial fabric of the present invention is not particularly limited to a specific structure so long as the weft has a multilayered structure. The warp structure of the industrial fabric may be provided with the multilayered one.

Moreover, the yarn for use in the present invention can freely be selected in accordance with the properties required for the industrial fabric, and is not particularly limited. In addition to a monofilament, for example, a multifilament, a spun yarn, a generally textured yarn subjected to a crimping or bulking processing, a bulky yarn, a stretch yarn, a processed yarn called raising yarn, a chenille yarn, a yarn formed by intertwisting or combining otherwise these yarns, and the like can be used. Furthermore, the sectional shape of the yarn is not limited to a circular shape, and the yarn with a square shape, a star shape or another rectangular shape, a flat shape, an elliptic shape, or a hollow shape can be used.

Moreover, yarn properties can freely be selected, and polyester, nylon, polyphenylene sulfide, polyvinylidene fluoride, polypropylene, aramid, polyether ketone, polyethylene naphthalate, cotton, wool, metal, and the like can be used.

Of course, the yarn with the copolymer or these properties blended with or containing various substances in accordance with purposes may be used.

When the spun yarn, the processed yarn subjected to the crimping or bulking processing, the chenille yarn, and other yarns having flexibility and a large apparent linear diameter are used in the upper layer weft, the upper layer surface can be easily covered with these yarns. Therefore, a difference between the ordinary part and the joined part can preferably be narrowed to such an extent that the difference cannot be noticed as seen from the side of the upper layer.

EXAMPLES

The embodiments for carrying out the present invention will be described with reference to drawings.

FIG. 1 is a sectional view showing one embodiment of a joining loop according to the present invention.

The fabric is one-layer-warp and three-layer-weft structure which comprises one layer of warp and three arranged layers of an upper layer weft 8, middle layer weft 9, and lower layer weft 10. In the part where both ends are butt-joined, one thread of upper layer weft of each end is left, and the underlying middle layer weft 9 and lower layer weft 10 are removed to form a loop forming part 3.

A remaining upper layer weft 1 is an upper layer weft left in the right end, and a remaining upper layer weft 2 is an upper layer weft left in the left end.

A right end warp 4 weaves in the remaining upper layer weft 1. The warp 4 weaving in the remaining upper layer weft 1 is folded back to form a joining loop 11. The folded warp is woven into an ordinary part. A warp 5 shown by a broken line is a part of the warp 4 folded and woven into the ordinary part.

In the present embodiment, the warp 4 is woven in the part where the warp adjacent to the warp 4 originally exists according to the texture, and the warp which is to originally exist is cut midway, folded back and butt-joined with the woven warp 4 to entirely form one thread of warp. Moreover, when the warp 4 is folded back, the warp is twisted, and closely engaged with each weft on the texture so that the curved shape of the folded warp 4 becomes the same as the curved shape of the warp which is to originally exist.

Moreover, naturally, in the present embodiment, the warp weaving in the remaining upper layer weft is folded back to form the joining loop and then woven into the ordinary part. Alternatively, however, the warp, after the warp is folded back to form the joining loop, may weave in the remaining upper layer weft and be woven into the ordinary part. Specifically, the warp originally present in the part of the warp 5 may be folded back and woven into the part of the warp 4.

The left end warp does not weave in the present upper layer weft 2, a warp 6 not weaving in the remaining upper layer weft 2 is folded back to form a joining loop 12. The folded warp is woven into the ordinary part in a similar manner as in the right end. A warp 7 in a broken line is a part of the warp 6 folded back and woven into the ordinary part.

Moreover, it goes without saying that both end warps forming the joining loops may be of the continuous same thread, or different threads. The joining loops to be engaged may be formed of the same thread, or different threads.

Subsequently, both end joining loops 11, 12 are engaged with each other to form a common hole 14, a core line 15 is inserted through the common hole 14 and both ends are joined.

Since the remaining upper layer wefts 1, 2 exist in the upper layer, and the joining loops are formed below, the upper layer surface similar to that of the ordinary part can be obtained without any joining loop protruded to the upper layer surface or any opening produced in the joined part.

Figure 2:
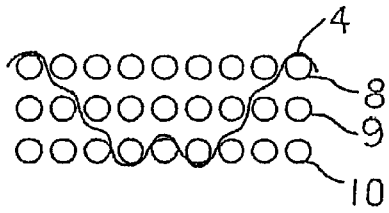
FIG. 2 is a warp sectional view showing a woven texture.

FIG. 2 is a warp sectional view showing the warp texture of the ordinary part of the fabric according to the present embodiment shown in FIG. 1.

It can be seen that a warp weaves an upper layer weft from above thereof and a next upper layer weft from above thereof at an interval of seven upper layer wefts. The warp weaves in two lower layer wefts between which one lower layer weft is held and at an interval of five lower layer wefts in the texture.

FIGS. 3 to 6 are sectional views of the warp constituting a repeating unit in the weft direction of the joined part in which the joining loops of the first embodiment are formed.

Figure 3:
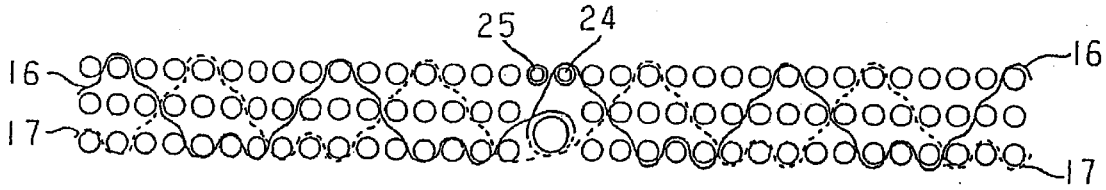
FIG. 3 is a warp sectional view constituting a repeating unit in the width direction of a joined part according to an embodiment of the present invention.
Figure 4:
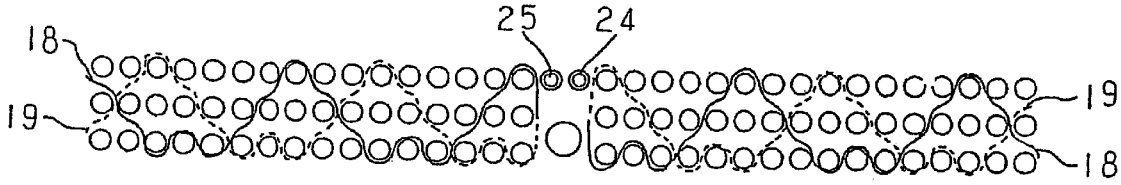
FIG. 4 is a warp sectional view constituting a repeating unit in the width direction of a joined part according to another embodiment of the present invention.
Figure 5:
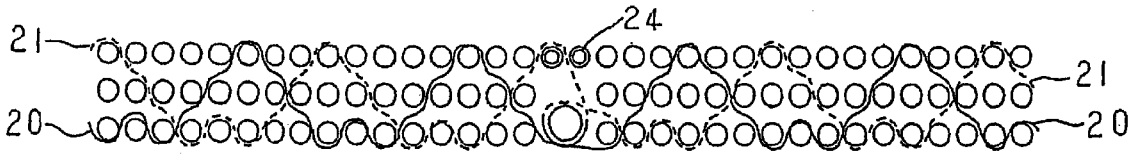
FIG. 5 is a warp sectional view constituting a repeating unit in the width direction of a joined part according to yet another embodiment of the present invention.
Figure 6:
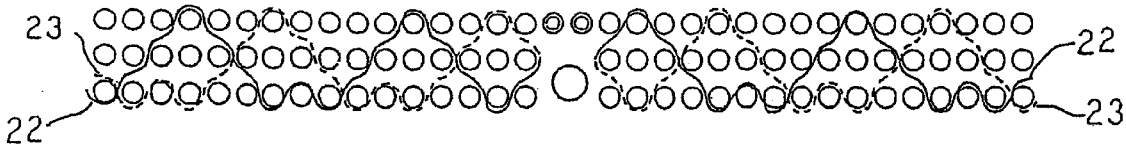
FIG. 6 is a warp sectional view of a repeating unit in the width direction of a joined part according to still another embodiment of the present invention.

Specifically, warps 16 and 17 shown in FIG. 3, warps 18 and 19 shown in FIG. 4, warps 20 and 21 shown in FIG. 5, and warps 22 and 23 shown in FIG. 6 are arranged in order in the weft direction, so that the joined parts and fabrics are formed.

In the present embodiment, the right end and left end warps denoted with the same reference numeral is the continuous same warp.

Eight warps 16 to 23 form the repeating units and the adjacent warps such as the warps 16 and 17 shown in FIG. 3, warps 18 and 19 shown in FIG. 4, warps 20 and 21 shown in FIG. 5, and warps 22 and 23 shown in FIG. 6 form a set.

Specifically, the warp 16 is folded back and woven into the part of the warp 17, the warp 18 is folded back and woven into the part of the warp 19, the warp 20 is folded back and woven into the part of the warp 21, and the warp 22 is folded back and woven into the part of the warp 23 according to the texture. The warps originally present in the parts of the warps 17, 19, 21, 23 are cut midway, and butt-joined with the folded-back warps 16, 18, 20, 22 to entirely form one thread of warp. The folded-back warps 16, 18, 20, 22 have the same textures as those of the warps originally present to constitute the fabric.

For the sake of convenience in the specification, these warps are represented as the same warp in some cases.

In the present embodiment, the joining loop of the first embodiment is disposed in the part of the warps 16, 17 shown in FIG. 3. The right warp 16 weaves in a remaining upper layer weft 24, and is folded back to form the joining loop. The left warp 16 weaves in no remaining upper layer weft 25.

Moreover, in the present embodiment, the joining loop is also disposed in the part of the warps 20, 21 shown in FIG. 5. For this joining loop, the left warp 20 is folded back to form the joining loop, then weaves in the remaining upper layer weft 25 and is woven into the ordinary part as the warp 21. The right end warps 20, 21 do not weave in a remaining upper layer weft 24.

As described above, since the right end remaining upper layer weft 24 is woven in by the warp 16 shown in FIG. 3, the left end remaining upper layer weft 25 is woven in by the warp 21 shown in FIG. 5, and both end remaining upper layer wefts are once woven in by the warp in the width direction, the remaining upper layer wefts are prevented from dropping out of the texture.

In the combinations of the warps 18, 19 shown in FIG. 4 and warps 22, 23 shown in FIG. 6, the warps are only folded back without forming the joining loop, but these warps inhibit the weft of the end from moving toward the core line.

Moreover, in the present embodiment, the existing wefts and warps, including the remaining upper layer weft, are woven according to the texture without destroying the texture of the ordinary part.

It can well be understood that the texture is not destroyed since each of the warps of both sides weaves in one of upper layer wefts including the remaining weft from above the one of the upper layer wefts at an interval of seven upper layer wefts in a repeating unit.

For example, the right end warp 16 shown in FIG. 3 weaves in the remaining upper layer weft 24 and the ninth and seventeenth upper layer wefts counted from the upper layer weft 24, and there are seven upper layer wefts between i the weaving positions.

The right end warp 20 shown in FIG. 5 weaves in the fifth and thirteenth upper layer wefts counted from the remaining upper layer weft 24. However, since there are only four upper layer wefts including the remaining upper layer weft between the fifth woven upper layer weft and the end, the warp is folded back without weaving in the remaining upper layer weft 24.

Since the weaving of the warp and upper layer weft including the remaining upper layer weft is performed in the same manner as in the woven texture of the ordinary part, there are those warps which weave in the remaining upper layer weft and those warps which do not weave in the remaining upper layer weft. The weaving is performed according to the texture up to the remaining upper layer weft of the endmost part.

Therefore, in the present embodiment, in addition to the above-described advantage that since the loop forming part is covered with the remaining upper layer weft, no loop appears on the surface, and no opening is made, there is an advantage that in the remaining weft part on each side, the texture of the ordinary part is not destroyed, and the surface equal to that of the ordinary part is formed.

Furthermore, in the present embodiment the relation of the warp texture between the right end and the left end is matched according to the texture.

It can well be understood even from the relation between the right warp and the left warp that the warp weaves in one upper layer including the remaining upper layer weft from thereabove, with the interval of seven upper layer wefts.

For example, the right end warp 16 shown in FIG. 3 weaves in the remaining upper layer weft 24, the left end warp 16 weaves in the eighth upper layer weft counted from the remaining upper layer weft 25, and there are seven upper layer wefts between both weaving positions.

Moreover, the right end warp 17 weaves in the fourth upper layer weft counted from the remaining upper layer weft 24, the left end warp 17 weaves in the fifth upper layer weft counted from the remaining upper layer weft 25, and there are seven upper layer wefts between both weaving positions.

Similarly in FIGS. 4 to 6, seven upper layer wefts exist between both weaving positions. By this constitution, even in the relation of both ends of the joined part, the upper layer texture is not destroyed at all, and the surface similar to that of the ordinary part can be obtained. Of course, any twill weave is not destroyed.

Figure 7:
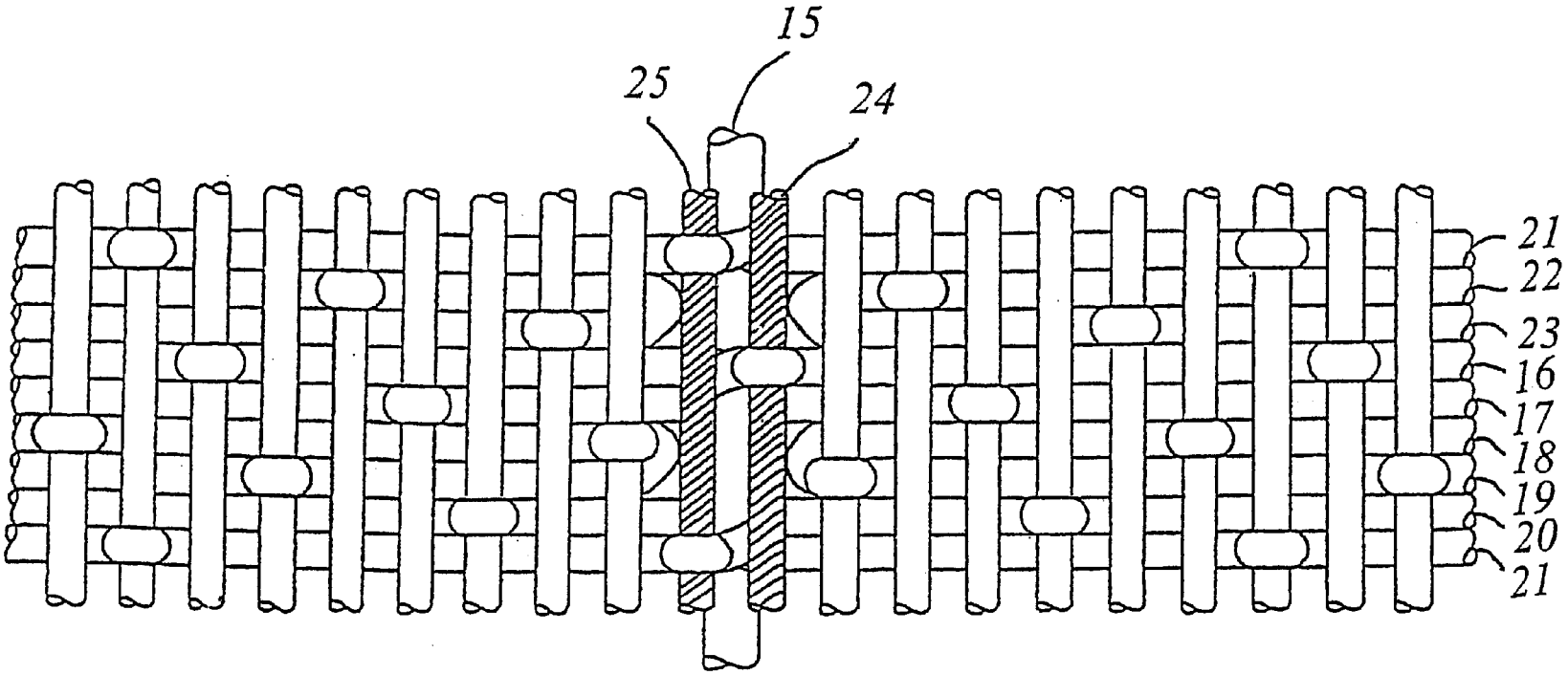
FIG. 7 is a plan view showing an upper layer of the joined part formed by the warps shown in FIGS. 3 to 6.
Figure 8:
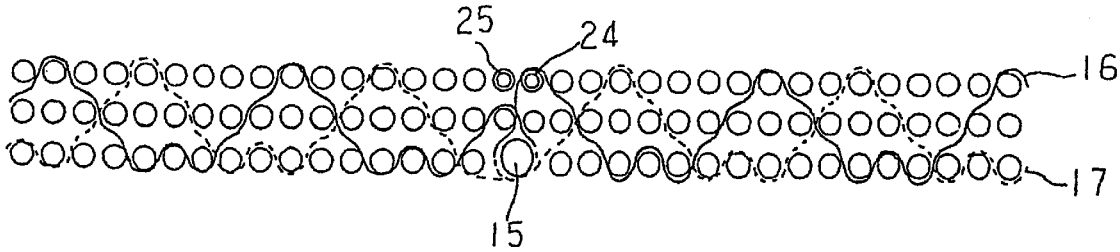
FIG. 8 is a warp sectional view constituting a repeating unit in the width direction of a joined part according to another embodiment of the present invention.
Figure 9:
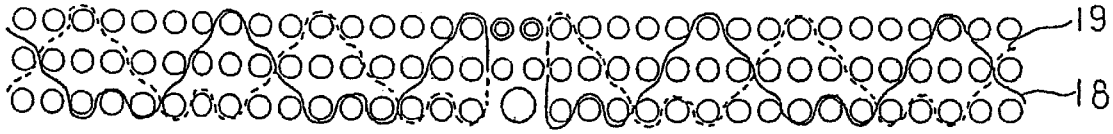
FIG. 9 is a sectional view of the warp constituting a repeating unit in the width direction of a joined part according to further another embodiment of the present invention.
Figure 10:
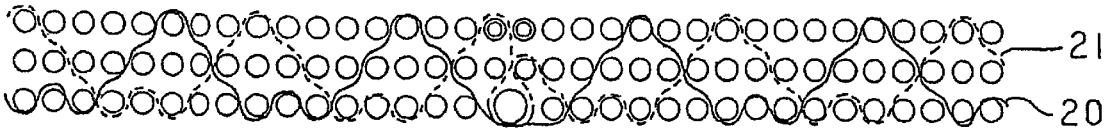
FIG. 10 is a warp sectional view constituting a repeating unit in the width direction of a joined part according to another embodiment of the present invention.
Figure 11:
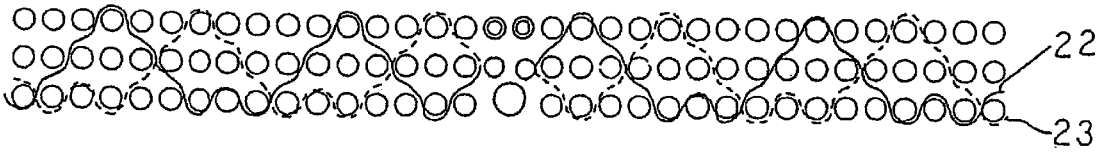
FIG. 11 is a warp sectional view constituting the repeating unit in the width direction of a joined part according to another embodiment of the present invention.
Figure 12:
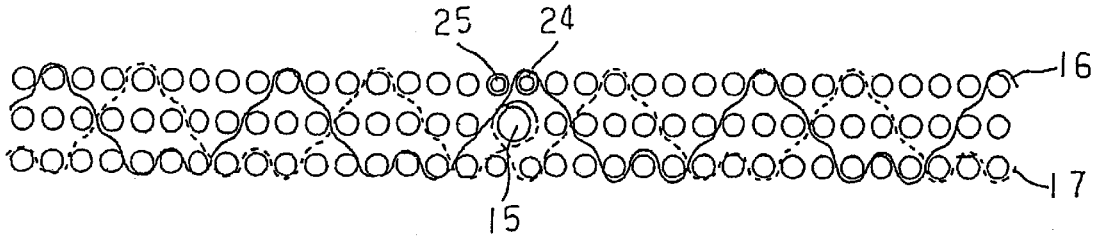
FIG. 12 is a warp sectional view constituting a repeating unit in the width direction of a joined part according to another embodiment of the present invention.
Figure 13:
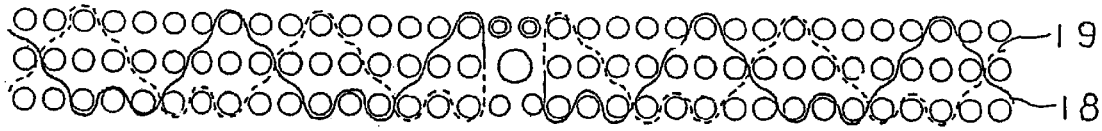
FIG. 13 is a warp sectional view constituting a repeating unit in the width direction of a joined part according to another embodiment of the present invention.
Figure 14:
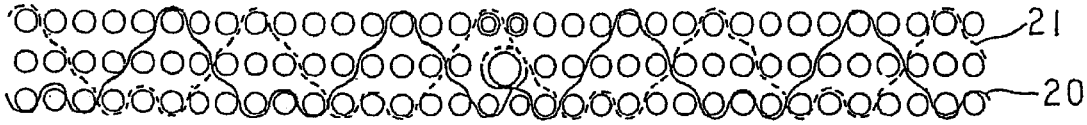
FIG. 14 is a warp sectional view constituting a repeating unit in the width direction of a joined part according to another embodiment of the present invention.
Figure 15:
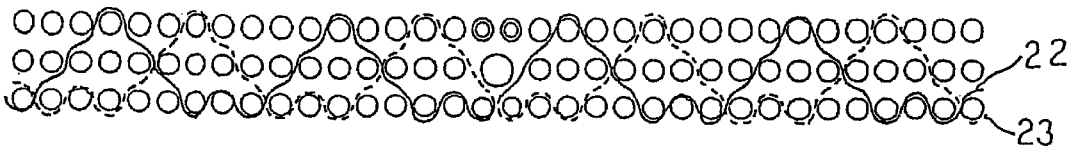
FIG. 15 is a warp sectional view constituting a repeating unit in the width direction of a joined part according to another embodiment of the present invention.
Figure 16:
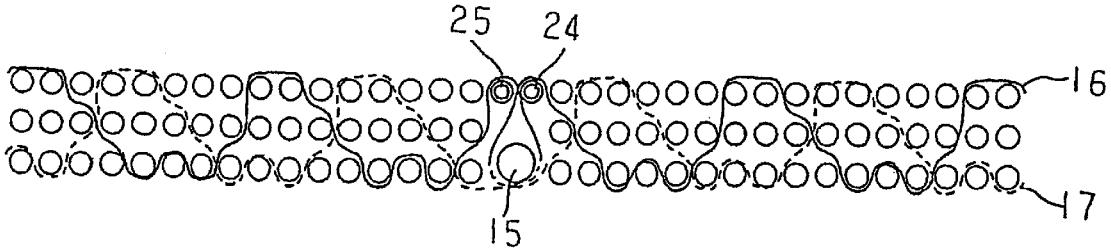
FIG. 16 is a warp sectional view constituting a repeating unit of the width direction of a joined part according to another embodiment of the present invention.
Figure 17:
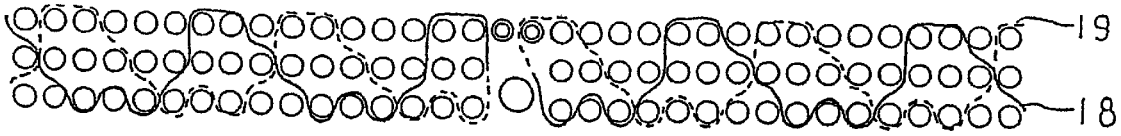
FIG. 17 is a warp sectional view constituting a repeating unit in the width direction of a joined part according to another embodiment of the present invention.
Figure 18:
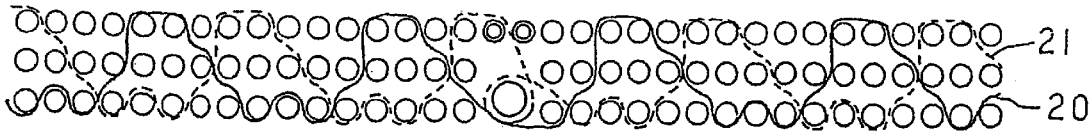
FIG. 18 is a warp sectional view constituting a repeating unit in the width direction of a joined part according to another embodiment of the present invention.
Figure 19:
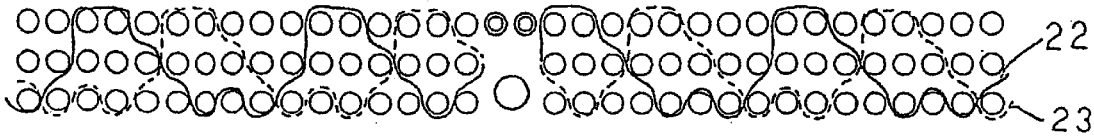
FIG. 19 is a warp sectional view constituting a repeating unit in the width direction of a joined part according to another embodiment of the present invention.

FIG. 7 is a plan view of the joined part shown in FIGS. 3 to 6 as seen from the upper layer surface side.

The warps 16 to 23 shown in FIGS. 3 to 6 correspond to the warps 16 to 23 of FIG. 7.

It can well be understood that, even in the plan view of the joined part shown in FIG. 7 that the loop forming part is covered with the remaining upper layer wefts and does not appear on the surface, any opening is not made, the upper layer fabric is not destroyed at all, and that even the twill weave is matched on the left and right.

FIGS. 8 to 11 are warp direction sectional views which constitute repeating units of the wefts at the joined part according to another embodiment.

In this embodiment, the upper layer wefts and middle layer wefts of both ends are allowed to remain. Only the lower layer weft is removed. The other woven textures are the same as those of the embodiment shown in FIGS. 3 to 6.

The structure of the joined part is much closer to that of the ordinary part, and the differences in various performances such as air permeability can advantageously be reduced. The loop diameter is slightly reduced.

FIGS. 12 to 15 are warp direction sectional views which constitute repeating units of the wefts at the joined part according to another embodiment.

In this embodiment, the upper layer wefts and lower layer wefts of both ends are allowed to remain. Only the middle layer wefts are removed. The other woven textures of other parts are the same as those of the embodiment shown in FIGS. 3 to 6.

Although the common holes at the loop are invisible from both the front and the back surfaces, even the structure of the lower layer surface can advantageously be formed equally to the ordinary part.

FIGS. 16 to 19 are warp direction sectional views constituting repeating units of the wefts at the joined part according to yet another embodiment.

In this embodiment, the woven texture is constituted that each of warps weaves two adjacent upper layer wefts. The other woven textures are the same as those of the embodiment shown in FIGS. 3 to 6.

Additionally in this embodiment, different from the above-described embodiements, both end warps weave in the remaining upper layer wefts to form the joining loops, as apparent from the pair of the warps 16, 17. This results from the weaving of the warps and wefts including the remaining upper layer wefts without destroying the woven texture of the wefts.

As described above, various patterns of joining loops can be formed depending on woven textures and number of remaining upper layer wefts, when the woven texture is matched in the present invention.

The joining loops and the joined part of the present invention, although the joining method is performed by forming loops so that the endless or ended shape can freely be formed as described above, superior effects can be obtained that the joining loop forming part does not appear on the surface, that no opening is made in the joined part, and that the structure of the conveying surface at the joined part can be formed substantially equally to that of the ordinary part.

Japanese Patent Application No. 11-76263 filed Feb. 16, 1999 is hereby incorporated by reference in its entirety.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claime is:

1. A joining loop in combination with an industrial fabric which comprises:

first and second ends and an ordinary part of said industrial fabric, each comprising an arrangement of wefts in multiple layers, wherein said first end comprises a first remaining weft in at least an upper layer, and a loop forming part below said first remaining weft where a removed weft would normally be disposed;

the joining loop, formed in said loop forming part and that joins said first and second ends, comprising first and second warps folded back respectively into said first and second ends to form first and second end-joining loops; and a core line, inserted in a common hole of the joining loop, the common hole being formed by engaging both end-joining loops with each other, wherein a first tip end of the first warp is woven into the ordinary part to form the first end-joining loop, and a second tip end of the second warp is woven into the i ordinary part to form the second end-joining loop to form the common hole below the first remaining weft.

2. The joining loop and industrial fabric according to claim 1, wherein the first warp is folded back in the loop forming part before the first warp is woven with the first remaining weft in the same woven texture as an upper layer woven texture of the ordinary part, and before the first tip end of the warp is woven into the ordinary part.

3. The joining loop and industrial fabric according to claim 1, wherein the first warp weaves in the first remaining weft before the first warp is folded back in the loop forming part, and before the first tip end is woven into the ordinary part to form the first end-joining loop.

4. The joining loop and industrial fabric according to any one of claims 1 to 3, wherein in th loop forming part, the second warp of the second end is also folded back, the folded second warp is woven with a second remaining weft of an upper layer part of said second end, and the second tip end is woven into the ordinary part to form the second end-joining loop.

5. The joining loop and industrial fabric according to claim 4, wherein the second warp is folded back before the second warp is woven with the second remaining weft in the same woven texture as the upper layer woven texture of the ordinary part and the second tip end is woven into the ordinary part to form the second end-joining loop.

6. The joining loop and industrial fabric according to any one of claims 1 to 3, wherein the second warp is woven with the first retaining weft before the second warp is folded back and the second tip end of the warp is woven into the ordinary part to form the joining loop.

7. The joining loop and industrial fabric according to claim 1, wherein the first warp that is folded back and woven into the ordinary part is butt-joined with a third warp that is cut to an adjusted length to form one thread of warp.

8. The joining loop and industrial fabric according to claim 1, wherein the first warp is folded back, and woven into the ordinary part between adjacent warps.

9. A joined part of an industrial fabric, said joined part comprises:

first and second ends and first and second ordinary parts of said industrial fabric, each comprising an arrangement of wefts in multiple layers, said first end comprising a first remaining weft in at least an upper layer, and a loop forming part below said first remaining weft where a removed weft would normally be disposed; and a joining loop, formed in said loop forming part and that joins said first and second ends, comprising first and second warps folded back respectively into said first and second ends to form first and second end-joining loops, wherein a first tip end of the first warp is woven into the first ordinary part to form the first end-joining loop, and a second tip end of the second warp is woven into the second ordinary part to form the second end-joining to form a common hole below the first remaining weft, and a core line is inserted into the joining loop common hole formed by enraging both end-joining loops with each other.

10. The joined part of the industrial fabric according to claim 9, wherein an upper layer texture of the joined part of the industrial multilayered fabric formed in an endless shape using the joining loop is the same as the upper layer texture of the ordinary part of the multilayered fabric.

11. The joined part of the industrial fabric according to claim 9, wherein an upper layer texture of the joined part of the industrial multilayered fabric formed in an endless shape using the joining loop is different from the upper layer texture of the ordinary part of the multilayered fabric.

12. The joined part of the industrial fabric according to claim 9, wherein the warps of both end textures of the fabric joined in an endless manner using the joining loop deviate by one thread of the warps to a plurality of threads of the warps, and the loops are engaged.

13. The joined part of the industrial fabric according to claim 9, wherein both end warps of the fabric joined in the endless manner using the joining loop are engaged with the loop of the same warp.

14. The joined part of the industrial fabric according to claim 9, wherein both end joining loops are formed by folding back the first warp at the end, and weaving the folded first warp with the remaining first weft of the upper layer part in the same woven texture as the upper layer woven texture of the ordinary part.

15. The joined part of the industrial fabric according to claim 9, wherein the second end-joining loop of both end joining loops is formed by folding back and weaving in the second warp of the end without weaving the warp with the remaining first weft of the upper layer part.

16. The joined part of the industrial fabric according to claim 9, wherein the joining loop is formed on a plurality of warps.

* * * * *